US012041972B2

(12) United States Patent
Jung

(10) Patent No.: US 12,041,972 B2
(45) Date of Patent: Jul. 23, 2024

(54) AEROSOL GENERATING DEVICE

(71) Applicant: KT&G CORPORATION, Daejeon (KR)

(72) Inventor: Hyung Jin Jung, Seoul (KR)

(73) Assignee: KT&G CORPORATION, Daejeon (KR)

( * ) Notice: Subject to any disclaimer, the term of this patent is extended or adjusted under 35 U.S.C. 154(b) by 568 days.

(21) Appl. No.: 17/295,578

(22) PCT Filed: Dec. 22, 2020

(86) PCT No.: PCT/KR2020/018883
§ 371 (c)(1),
(2) Date: May 20, 2021

(87) PCT Pub. No.: WO2021/141290
PCT Pub. Date: Jul. 15, 2021

(65) Prior Publication Data

US 2023/0017816 A1 Jan. 19, 2023

(30) Foreign Application Priority Data

Jan. 6, 2020 (KR) ..... 10-2020-0001701
Apr. 28, 2020 (KR) ..... 10-2020-0051821

(51) Int. Cl.
*A24F 40/51* (2020.01)
*A24F 40/53* (2020.01)

(52) U.S. Cl.
CPC ..... *A24F 40/51* (2020.01); *A24F 40/53* (2020.01)

(58) Field of Classification Search
CPC ..... A24F 40/51; A24F 40/53
USPC ..... 131/329
See application file for complete search history.

(56) References Cited

U.S. PATENT DOCUMENTS 10,750,782 B2 8/2020 Batista
10,905,169 B2 2/2021 Bilat et al.
2009/0133691 A1* 5/2009 Yamada ..... A61M 11/005 128/200.16

(Continued)

FOREIGN PATENT DOCUMENTS

CN 110301677 A 10/2019
CN 110612034 A 12/2019

(Continued)

OTHER PUBLICATIONS

Office Action issued Sep. 6, 2022 in Japanese Application No. 2021-541690.

(Continued)

*Primary Examiner* — Peter G Leigh
(74) *Attorney, Agent, or Firm* — Sughrue Mion, PLLC

(57) ABSTRACT

An aerosol generating device includes an accommodation portion into which an aerosol generating article is inserted, a heater configured to hear the aerosol generating article inserted in the accommodation portion, a temperature sensor configured to measure a temperature of the heater, and a controller configured to acquire temperature data of the heater based on the temperature of the heater measured by the temperature sensor. The controller may generate a reuse detection signal based on a change in the temperature data which is caused by the insertion of the aerosol generating article.

15 Claims, 8 Drawing Sheets

(56) References Cited

U.S. PATENT DOCUMENTS

| | | | | |
|---|---|---|---|---|
| 2014/0020693 | A1 | 1/2014 | Cochand et al. | |
| 2015/0122274 | A1 | 5/2015 | Cohen et al. | |
| 2016/0022930 | A1 | 1/2016 | Greim et al. | |
| 2016/0302488 | A1* | 10/2016 | Fernando | G01N 21/31 |
| 2018/0199630 | A1* | 7/2018 | Qiu | A61M 15/06 |
| 2019/0191783 | A1* | 6/2019 | Courbat | A24D 1/20 |
| 2019/0380389 | A1 | 12/2019 | Hong et al. | |
| 2020/0093185 | A1* | 3/2020 | Lim | A24F 40/51 |
| 2020/0359681 | A1 | 11/2020 | Han et al. | |
| 2021/0212170 | A1 | 7/2021 | Bilat | |

FOREIGN PATENT DOCUMENTS

| | | | | |
|---|---|---|---|---|
| EP | 2 468 118 | A1 | 6/2012 | |
| JP | 2017-527266 | A | 9/2017 | |
| KR | 10-2017-0129710 | A | 11/2017 | |
| KR | 10-2018-0129637 | A | 12/2018 | |
| KR | 10-2019-0033531 | A | 3/2019 | |
| KR | 102231228 | B1 * | 3/2021 | A24B 15/16 |
| WO | WO-2015082560 | A1 * | 6/2015 | A24B 15/167 |
| WO | 2016/005602 | A1 | 1/2016 | |
| WO | WO-2018050701 | A1 * | 3/2018 | A24D 1/20 |
| WO | 2019/090200 | A1 | 5/2019 | |
| WO | 2019/129845 | A1 | 7/2019 | |
| WO | 2020/006311 | A1 | 1/2020 | |

OTHER PUBLICATIONS

Notification of Reason for Refusal dated Nov. 12, 2021 from the Korean Intellectual Property Office in KR Application No. 10-2020-0015175.

Extended European Search Report dated Nov. 19, 2021 from the European Patent Office in EP Application No. 20888731.5.

International Search Report for PCT/KR2020/018883 dated Apr. 7, 2021 [PCT/ISA/210].

Written Opinion for PCT/KR2020/018883 dated Apr. 7, 2021 [PCT/ISA/237].

Office Action dated Mar. 1, 2023 from the Korean Patent Office in Application No. 10-2023-0012074.

Office Action dated Apr. 18, 2023 from the Chinese Patent Office in Application No. 202080006366.3.

Office Action issued Mar. 22, 2023 in Japanese Application No. 2021-541690.

* cited by examiner

AEROSOL GENERATING DEVICE

CROSS REFERENCE TO RELATED APPLICATIONS

This application is a National Stage of International Application No. PCT/KR2020/018883 filed Dec. 22, 2020, claiming priority based on Korean Patent Application No. 10-2020-0001701 filed Jan. 6, 2020 and Korean Patent Application No. 10-2020-0051821 filed Apr. 28, 2020.

TECHNICAL FIELD

Embodiments relate to an aerosol generating device, and more particularly, to an aerosol generating device including a temperature sensor for measuring a temperature of a heater.

BACKGROUND ART

In recent years, there has been an increasing need for an alternative to traditional combustive cigarettes. For example, many people use an aerosol generating device that generates an aerosol by heating an aerosol generating material in an aerosol generating article or a cartridge, rather than combusting a cigarette. Accordingly, research on heating-type aerosol generating articles and heating-type cartridges is actively being conducted.

DISCLOSURE

Technical Problem

Users may use an aerosol generating article after inserting it into an aerosol generating device. An aerosol generating article is usually made for a single use, so it is supposed to be discarded after being removed from the aerosol generating device.

However, there are cases in which some users reinserts used aerosol generating articles without discarding them. Reuse of aerosol generating articles may change flavor of aerosols generated from the aerosol generating articles, thereby, causing discomfort to a user.

Accordingly, there is a need for a method for preventing reuse of aerosol generating articles.

Embodiments provide an aerosol generating device that prevents reuse of an aerosol generating article based on a temperature change of a heater according to insertion of the aerosol generating article.

The technical problems to be solved by the present embodiments are not limited to the technical problems described above, and other technical problems may be inferred from the following embodiments.

Technical Solution

According to an embodiment, an aerosol generating device includes an accommodation portion into which an aerosol generating article is inserted, a heater configured to heat the aerosol generating article inserted in the accommodation portion, a temperature sensor configured to measure a temperature of the heater, and a controller configured to acquire temperature data of the heater based on the temperature of the heater measured by the temperature sensor, and the controller generates a reuse detection signal based on a change in the temperature data which is caused by the insertion of the aerosol generating article.

Advantageous Effects

An aerosol generating device according to embodiments may detect reinsertion and reuse of an aerosol generating article by analyzing a temperature change of a heater according to the insertion of the aerosol generating article.

When reuse of an aerosol generating article is detected, operation of an aerosol generating device may be stopped. Also, a notification unit provided in an aerosol generating device may notify a user of reuse of an aerosol generating article.

As reuse of an aerosol generating article is blocked, it is possible to prevent satisfaction of a user from being reduced due to a change in flavor of an aerosol that may occur due to reuse.

MODE FOR INVENTION

Figure 1:
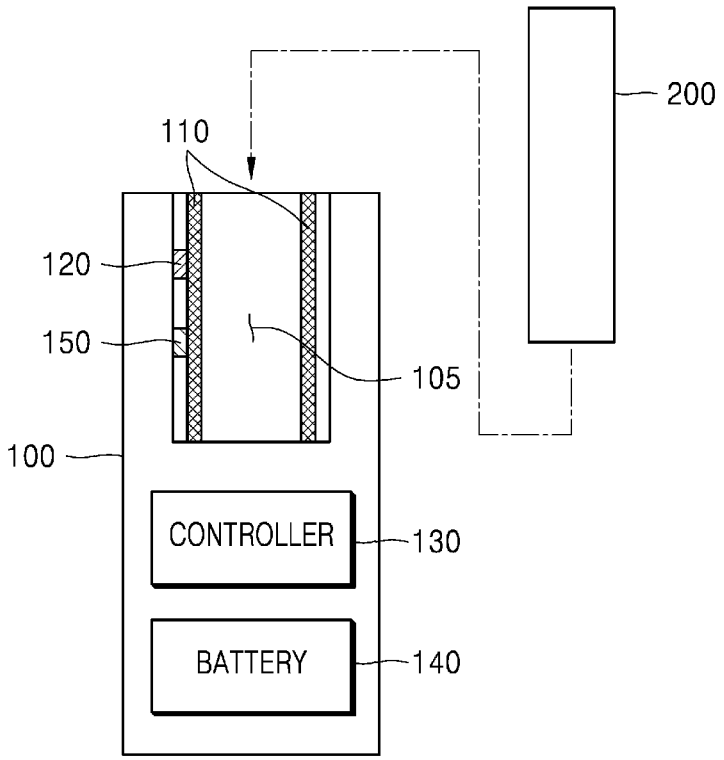
FIG. 1 is a cross-sectional view of an aerosol generating device according to an embodiment.

With respect to the terms used to describe the various embodiments, general terms which are currently and widely used are selected in consideration of functions of structural elements in the various embodiments. However, meanings of the terms can be changed according to intention, a judicial precedence, the appearance of new technology, and the like. In addition, there is a term randomly selected by the applicant in a certain case, and in this case, meaning of the term will be described in detail in the corresponding description of the embodiments. Accordingly, terms used in the present embodiments should be defined based on the meaning of the terms and content throughout the present embodiments, rather than a name of the simple term.

Unless explicitly described to the contrary, the word "comprise" and variations such as "comprises" or "comprising" will be understood to imply the inclusion of stated elements but not the exclusion of any other elements. In addition, the terms "-er", "-or", "unit", "portion", and "module" described in the specification mean units for processing at least one function and/or operation and can be implemented by hardware components or software components and combinations thereof.

Throughout the specification, "embodiments" are examples taken to efficiently describe particular aspects of the inventive concept, and the respective embodiments need not be mutually exclusive. For example, configurations disclosed in one embodiment may be applied to and implemented in other embodiments and may be changed, applied, and implemented without departing from the idea and scope of the present specification.

Meanwhile, terms used in the present specification are for describing the embodiments and are not intended to limit the embodiments. In this specification, a singular form also includes a plural form unless specifically stated in the phrase.

Throughout the specification, a "longitudinal direction" of a component may be a direction in which the component extends along one axis in one direction thereof, and in this case, the axis in one direction of the component may mean a direction in which the component extends longer than an axis in another direction crossing the axis in one direction.

As used herein, expressions such as "at least one of," when preceding a list of elements, modify the entire list of elements and do not modify the individual elements of the list. For example, the expression, "at least one of a, b, and c," should be understood as including only a, only b, only c, both a and b, both a and c, both b and c, or all of a, b, and c.

It will be understood that when an element is referred to as being "over," "above," "on," "connected to" or "coupled to" another element, it can be directly over, above, on, connected or coupled to the other element or intervening elements may be present. In contrast, when an element is referred to as being "directly over," "directly above," "directly on," "directly connected to" or "directly coupled to" another element, there are no intervening elements present. Like numerals refer to like elements throughout.

Hereinafter, the present disclosure will now be described more fully with reference to the accompanying drawings, in which exemplary embodiments of the present disclosure are shown such that one of ordinary skill in the art may easily work the present disclosure. The disclosure may, however, be embodied in many different forms and should not be construed as being limited to the embodiments set forth herein.

FIG. 1 is a cross-sectional view of an aerosol generating device 100 according to an embodiment.

The aerosol generating device 100 may include an accommodation portion 105 for accommodating an aerosol generating article 200 (e.g., a cigarette). The aerosol generating article 200 may include a tobacco rod and/or an aerosol generating material.

The tobacco rod may also be made of a tobacco sheet or may also be made of a strand. In addition, the tobacco rod may also be made of cut tobacco made by finely cutting a tobacco sheet. The tobacco sheet or the tobacco strand may contain nicotine.

The aerosol generating material may include at least one of, for example, glycerin, propylene glycol, ethylene glycol, dipropylene glycol, diethylene glycol, triethylene glycol, tetraethylene glycol, and oleyl alcohol, and is not limited thereto.

The aerosol generating article 200 and the accommodation portion 105 may have shapes corresponding to each other. For example, when the aerosol generating article 200 has a cylindrical shape, the accommodation portion 105 may also have a cylindrical shape to accommodate the aerosol generating article 200. However, the shapes of the aerosol generating article 200 and the accommodation portion 105 are not limited thereto, and may be changed as necessary.

The aerosol generating device 100 may include a heater 110 that heats the aerosol generating article 200 inserted in the accommodation portion 105. The heater 110 may be arranged in the accommodation portion 105. Heat from the heater 110 may be transferred to the aerosol generating article 200 to heat the aerosol generating article 200.

For example, the heater 110 of the aerosol generating device 100 may include a susceptor. The susceptor may be a tubular heating chamber made of steel use stainless (SUS). The susceptor may be heated by a change in a magnetic field that is caused by a coil (not illustrated) in the aerosol generating device 100. In addition, as another example, the heater 110 may be an electrically resistive heater 110. The heater 110 may include an electrically conductive track, and the heater 110 may be heated as a current flows through the electrically conductive track.

The heater 110 is not limited to the above-described example, and any heater capable of being heated to a desired temperature may be used. Here, the desired temperature may be preset in the aerosol generating device 100, or may be set to a temperature that a user wants.

The heater 110 may have a different shape according to embodiments, such as a tubular shape, a plate shape, a needle shape, or a rod shape, and it may heat the inside or the outside of the aerosol generating article 200 according to the shape of the heater 110. FIG. 1 illustrates that the heater 110 heats the outside of the aerosol generating article 200, but a heating method of the aerosol generating article 200 are not limited thereto, and may be changed in various ways as necessary.

A plurality of the heaters 110 may be arranged in the aerosol generating device 100. In this case, the plurality of heaters 110 may also be arranged to be inserted into the aerosol generating article 200 or may also be arranged outside the aerosol generating article 200. In an embodiment, some of the plurality of heaters 110 may be arranged to be inserted into the aerosol generating article 200, and the rest may be arranged outside the aerosol generating article 200.

The aerosol generating device 100 may include a temperature sensor 120 that measures a temperature of the heater 110.

The temperature sensor 120 may be inside the accommodation portion 105. The temperature sensor 120 may be arranged adjacent to the heater 110. For example, when the heater 110 is an external heating-type heater that heats the aerosol generating article 200 from the outside, the temperature sensor 120 may be arranged adjacent to an outer surface of the heater 110. The aerosol generating device 100 may include other sensors in addition to the temperature sensor 120.

The aerosol generating device 100 may include a battery 140 and a controller 130.

The battery 140 supplies a power used to operate the aerosol generating device 100. For example, the battery 140 may supply a power such that the heater 110 for transferring heat to the aerosol generating article 200 is heated. In addition, the battery 140 may supply a power required to operate a sensor, a motor, or etc. that may be installed in the aerosol generating device 100.

The controller 130 controls overall operation of the aerosol generating device 100. Specifically, the controller 130 may operate the aerosol generating device 100 by controlling the battery 140. The controller 130 may control operations of other components included in the aerosol generating device 100. In addition, the controller 130 may also determine whether or not the aerosol generating device 100 is in an operable state by checking states of the respective components of the aerosol generating device 100.

The controller 130 includes at least one processor. The processor may also be implemented by an array of a plurality of logic gates or may also be implemented by a combination of a general-purpose microprocessor and a memory in which a program executable in the microprocessor is stored. In addition, it may be understood by those skilled in the art to which the present embodiment belongs that the processor may be implemented by other types of hardware.

The controller 130 may acquire temperature data of the heater 110 based on a temperature of the heater 110 measured by the temperature sensor 120. The controller 130 may generate a reuse detection signal based on a change in temperature data of the heater 110. The temperature data of the heater 110 obtained by the controller 130 may be a temperature of the heater 110 recorded over time.

When the aerosol generating article 200 is inserted into the accommodation portion 105, a temperature of the aerosol generating article 200 and a temperature of the heater 110 may be different from each other. When the aerosol generating article 200 is inserted in the accommodation portion 105, heat may be transferred from the heater 110 to the aerosol generating article 200, and thereby, the temperature of the heater 110 may change.

The change in temperature data of the heater 110 may differ according to whether or not the aerosol generating article 200 is reused. A reference value for the change in temperature may be determined by repeated experiments, and may change depending on the aerosol generating article 200, a temperature of the heater 110, a shape of the heater 110, and so on. In the present embodiments, the reference value may be used to detect reuse of the aerosol generating article 200, but may be changed according to embodiments.

The aerosol generating device 100 may include an aerosol generating article detection sensor 150 that detects insertion and discharge of the aerosol generating article 200. The aerosol generating article detection sensor 150 may include at least one of a pressure sensor, an optical sensor, an infrared sensor, an inductive sensor, a capacitance sensor, a resistance sensor, and a geomagnetic sensor.

For example, the aerosol generating article detection sensor 150 may be an inductive sensor. The inductive sensor may detect insertion and discharge of the aerosol generating article 200 based on a change in inductance of the accommodation portion 105 according to the insertion and discharge of the aerosol generating article 200.

As another example, the aerosol generating article detection sensor 150 may be a pressure sensor. The pressure sensor may detect a pressure applied to a side wall or a lower wall of the accommodation portion 105 when the aerosol generating article 200 is inserted into or discharged from the accommodation portion 105, and may detect insertion and discharge of the aerosol generating article 200 based on a change in pressure of the accommodation portion 105.

The aerosol generating article detection sensor 150 may be electrically connected to the controller 130. The aerosol generating article detection sensor 150 may transmit an aerosol generating article insertion signal to the controller 130 when the aerosol generating article 200 is inserted, and may transmit an aerosol generating article discharge signal when the aerosol generating article 200 is discharged. The controller 130 may detect insertion and discharge of the aerosol generating article 200 according to a signal from the aerosol generating article detection sensor 150, and control the aerosol generating device 100 based on the detection.

Figure 2A:
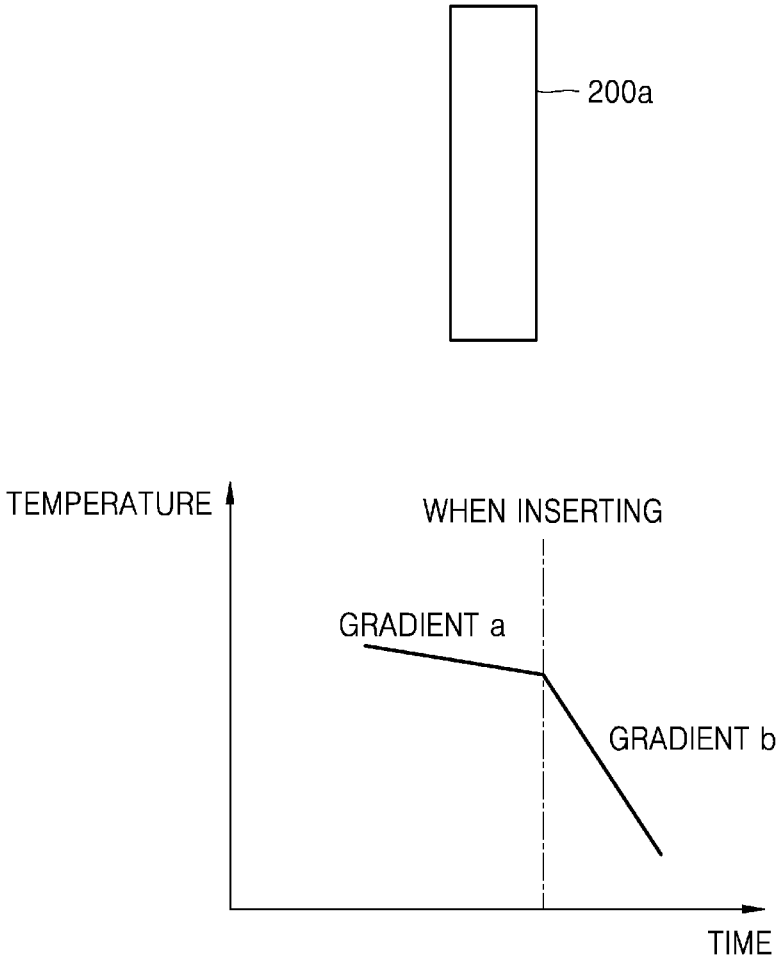
FIGS. 2A to 2C are diagrams of a temperature profile when an aerosol generating article is inserted into an aerosol generating device, according to an embodiment.
Figure 2B:
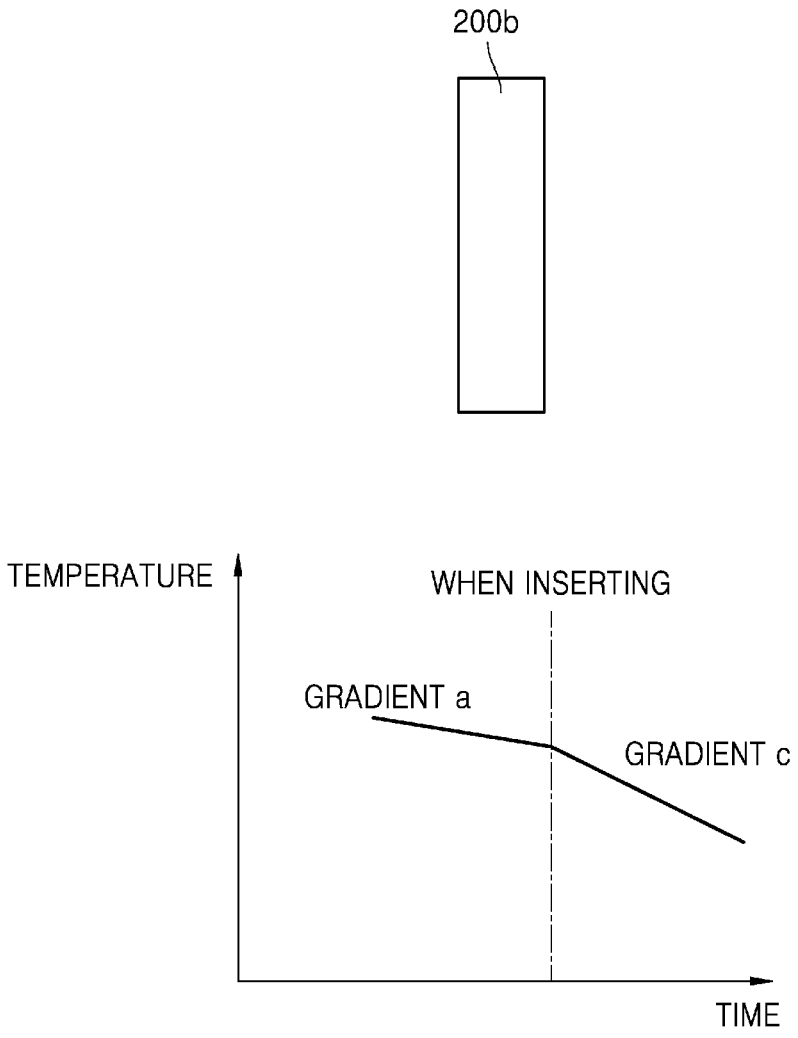
Figure 2C:
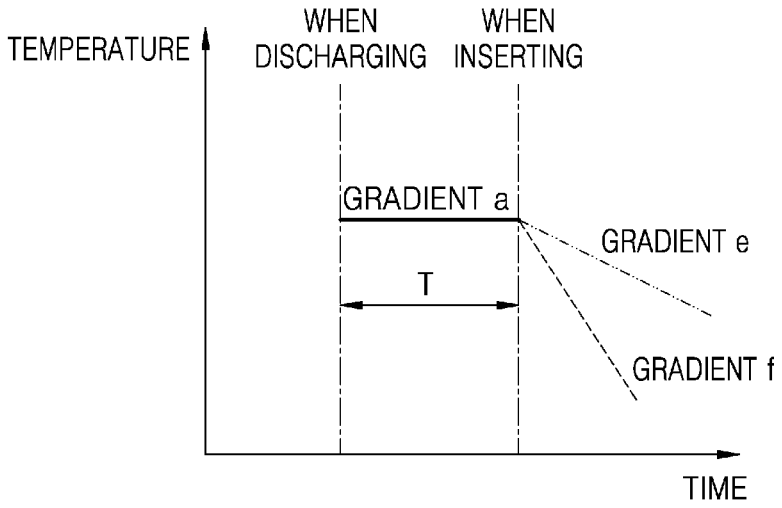

FIGS. 2A to 2C are exemplary diagrams of a temperature profile of the heater 110 when the aerosol generating article 200 is inserted into the aerosol generating device 100 illustrated in FIG. 1.

One exemplary method of distinguishing between first insertion and reinsertion (or between initial use and reuse) may be known in detail by comparing temperatures at the time of initial insertion and reinsertion of the aerosol generating article 200 with reference to FIGS. 2A and 2C.

Figure 3A:
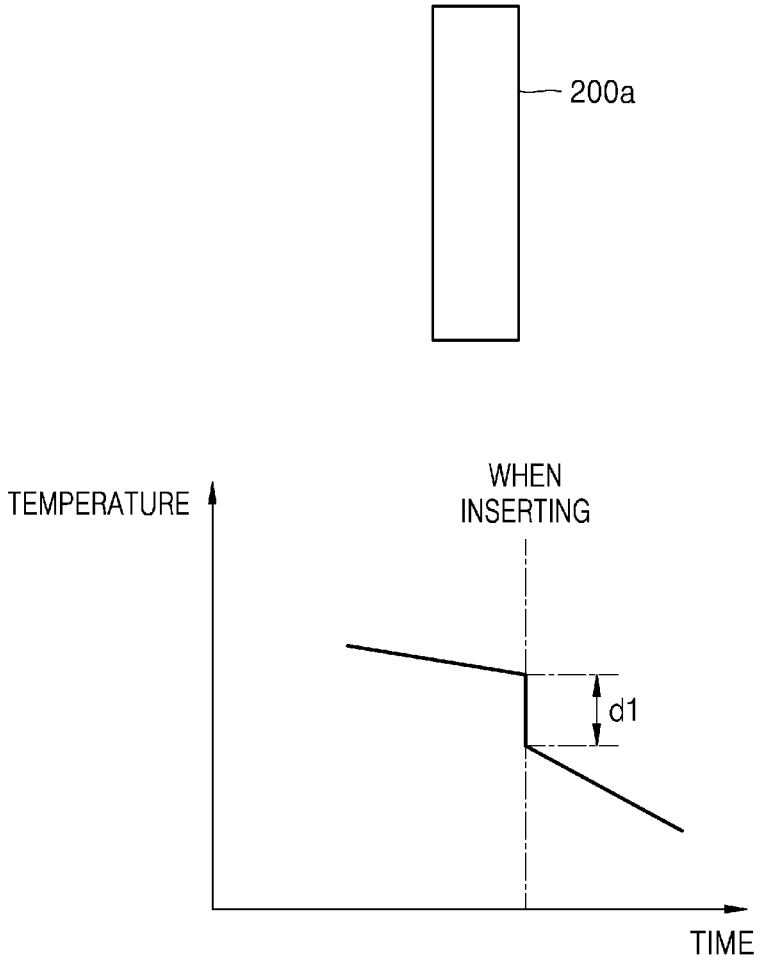
FIGS. 3A to 3C are diagrams of a temperature profile when an aerosol generating article is inserted into an aerosol generating device, according to another embodiment.
Figure 3B:
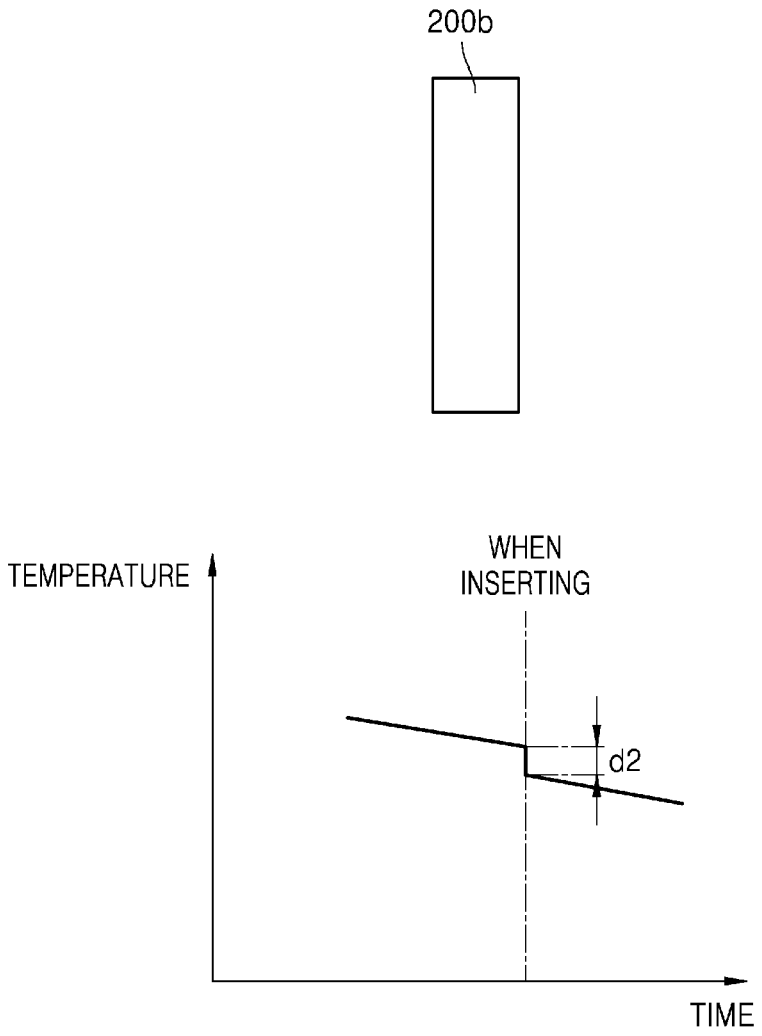
Figure 3C:
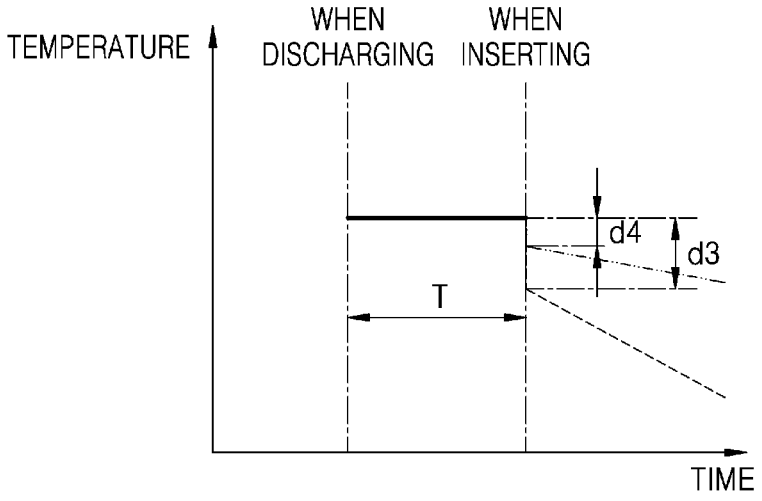

Temperature data of the heater 110 may include a temperature gradient of the heater 110. The temperature gradient of the heater 110 corresponds to a slope of a graph showing a temperature of the heater 110 over time as shown in FIGS. 3A-3C. The temperature gradient may change after the aerosol generating article 200 is inserted into the aerosol generating device 100, the temperature gradient may change according to whether or not the aerosol generating article 200 is preheated.

This is because a temperature difference between the aerosol generating article 200 and the heater 110 is greater when the aerosol generating article 200 is not preheated than when the aerosol generating article 200 is preheated.

The aerosol generating article 200*a* is not in a preheated state if the aerosol generating article 200*a* is being used or inserted for the first time. In this case, temperature data (i.e., temperature gradient) of the heater 110 may change from gradient a to gradient b as illustrated in FIG. 2A.

On the other hand, an aerosol generating article 200*b* may be in a preheated state when the aerosol generating article 200*b* is reinserted or reused. When the preheated aerosol generating article 200*b* is inserted into the accommodation portion 105, temperature data (i.e., temperature gradient) of the heater 110 may change from gradient a to gradient c as illustrated in FIG. 2B.

As shown in FIGS. 2A and 2C, a temperature difference between the aerosol generating article 200*a* and the heater 110 is greater when the aerosol generating article 200*a* is not preheated than when the aerosol generating article 200*b* is preheated. In other words, the rate of change in the temperature gradient shown in FIG. 2A may be greater than the rate of change in the temperature gradient shown in FIG. 2B.

The rate of change in the temperature data of the heater 110 may be defined as a ratio of a temperature gradient of the heater 110 after insertion to a temperature gradient of the heater 110 before insertion. The controller 130 may generate a reuse detection signal or a reuse non-detection signal based on a change in temperature data according to insertion of the aerosol generating article 200.

For example, when the rate of change in a temperature gradient of the heater 110 is greater than or equal to 150%, the controller 130 may generate the reuse non-detection signal.

In addition, when the rate of change in gradient of the temperature data of the heater 110 is less than 150%, the controller 130 may generate the reuse detection signal.

However, the reference value of 150% is merely an example, and it may be changed to an optimal value after repeated experiments, depending on the aerosol generating article 200, a temperature of the heater 110, a shape of the heater 110, and so on.

For example, a rate of change in a temperature gradient may change depending on the ambient temperature (i.e., the temperature of an environment of the aerosol generating device 100). When the ambient temperature is high, the rate of change in the temperature gradient may be relatively small, and thereby, a reference value for the rate of change may modified accordingly.

As illustrated in FIG. 2C, a temperature of the heater 110 may be maintained constant for a predetermined time after the aerosol generating article 200 is discharged from the aerosol generating device 100. That is, when the aerosol generating article 200 is used for the first time and then discharged, the aerosol generating device 100 may maintain a temperature of the heater 110 constant for a predetermined time period.

For example, the temperature of the heater 110 at the time of discharging the aerosol generating article 200 may be maintained for the time period T. In this case, a temperature of the heater 110 at the time of discharging the aerosol generating article 200 may be in the range of 120° C. to 160° C., and the time period T may be 20 seconds to 40 seconds. However, the above-described temperature and time period T of the heater 110 are merely one example and may be changed to optimal values by an experiment.

When the temperature of the heater 110 is maintained for time period T at the time of discharging the aerosol generating article 200, in a case in which the aerosol generating article 200*a* that is not preheated is inserted into the accommodation portion 105, a temperature gradient of the heater 110 may change from the gradient a gradient f as illustrated in FIG. 2C.

If a preheated aerosol generating article 200*b* is inserted into the accommodation portion 105 during the time period T, the temperature gradient of the heater 110 may change from the gradient a (i.e., substantially zero) to the gradient e as illustrated in FIG. 2C.

As the temperature of the heater 110 is maintained constant for a predetermined time, a change in temperature data of the heater 110 may show up more clearly. That is, as the temperature of the heater 110 is maintained constant for a predetermined time, the change in temperature data of the heater 110, for example, a rate of change in a temperature gradient may increase.

A rate of change of the temperature gradient with respect to the gradient a may be greater in the case of the gradient f than the gradient e. When a rate of change in a temperature gradient is less than 150%, it may be determined that a change in temperature data is less than a predetermined reference value, and the controller 130 may generate a reuse detection signal. When the rate of change in the temperature gradient is greater than or equal to 150%, it may be determined that the change in temperature data is more than a predetermined reference value, and the controller 130 may generate a reuse non-detection signal.

FIGS. 3A to 3C are other exemplary diagrams of temperature data when the aerosol generating article 200 is inserted into the aerosol generating device 100 illustrated in FIG. 1.

Changes in temperature data at the time of initial insertion and reinsertion of the aerosol generating article 200 are shown FIGS. 3A and 3C, and another exemplary method of distinguishing between initial insertion and reinsertion (or between initial use and reuse) of the aerosol generating article 200 will be explained in detail.

When the aerosol generating article 200 is inserted into the aerosol generating device 100, a temperature of the heater 110 measured before the aerosol generating article 200 is inserted may be different from a temperature of the heater 110 measured after the aerosol generating article 200 is inserted. In this case, the patterns of change in temperature may be different from each other according to whether or not the aerosol generating article 200 is preheated.

The change in temperature data of the heater 110 may include a difference between a temperature of the heater 110 measured at a specific point in time before the aerosol generating article 200 is inserted and a temperature of the heater 110 measured at another specific point in time after the aerosol generating product 200 is inserted. For example, such temperature difference may be greater in a case where the aerosol generating article 200 is not preheated than in a case where the aerosol generating article 200 is preheated.

The aerosol generating article 200*a* is not preheated if the aerosol generating article 200*a* is being used for the first time. In this case, when the aerosol generating article 200*a* is inserted into the accommodation portion 105, a temperature of the heater 110 may be reduced by d1 as illustrated in FIG. 3A.

On the other hand, the aerosol generating article 200*b* may be preheated in a case where the aerosol generating article 200*b* is reinserted or reused. In this case, when the preheated aerosol generating article 200*b* is inserted into the accommodation portion 105, a temperature of the heater 110 may be reduced by d2 as illustrated in FIG. 3B.

The temperature difference between the aerosol generating article 200*a* and the heater 110 may be greater in a case where the aerosol generating article 200*a* is not preheated than in a case where the aerosol generating article 200*b* is preheated. Thus, a temperature difference d1 in FIG. 3A may be greater than the temperature difference d2 in FIG. 3B.

For example, if the temperature difference is greater than or equal to a predetermined reference value, it may be determined that the aerosol generating article was never used before, and the controller 130 may generate a reuse non-detection signal. For example, the reference value may be selected from a range of 1° C. to 3° C.

On the other hand, if the temperature difference is less than or equal to the predetermined reference value, it may be determined that the aerosol generating article is being reused, and the controller 130 may generate a reuse detection signal.

The above-described range of 1° C. to 3° C. is merely an example, and the reference value may be modified based on an experiment, depending on the aerosol generating article 200, a temperature of the heater 110, a shape of the heater 110, and so on.

For example, the reference value for the temperature difference may be changed depending on the ambient temperature. For example, when the aerosol generating device 100 is used in a high temperature environment, the temperature difference may be relatively small. Therefore, the predetermined reference value for the temperature difference may be changed accordingly.

The temperature data of the heater 110 may include an average temperature of the heater 110 during a predetermined period.

The temperature sensor 120 may periodically measure a temperature of the heater 110. Therefore, a change in temperature data may be determined based on an average temperature during a predetermined time period immediately before the aerosol generating article 200 is inserted and an average temperature during the predetermined period immediately after the aerosol generating article 200 is inserted.

For example, if a difference between an average temperature of the heater 110 during a period of 1 second immediately before the aerosol generating article 200 is inserted and an average temperature during the period of 1 second immediately after the aerosol generating article 200 is inserted is less than a predetermined reference value, the controller 130 may generate a reuse detection signal. If a temperature difference is greater than or equal to the predetermined reference value, the controller 130 may generate a reuse non-detection signal.

The length of the predetermined time period may differ according to embodiments. For example, it may be appropriately selected from a range of 0.5 seconds to 1.5 seconds.

In an embodiment, if a difference between an average temperature of the heater 110 during a period of 1 second immediately before the aerosol generating article 200 is inserted and an average temperature of the heater 110 for a period of 1 second immediately after the aerosol generating article 200 is inserted is less than 2° C., it may be determined that the aerosol generating article is reused, and the controller 130 may generate a reuse detection signal.

On the other hand, if a difference between an average temperature of the heater 110 during a period of 1 second immediately before the aerosol generating article 200 is inserted and an average temperature of the heater 110 for a period of 1 second immediately after the aerosol generating article 200 is inserted is greater than or equal to 2° C., it may be determined that the aerosol generating article was not used before, and the controller 130 may generate a reuse non-detection signal.

As illustrated in FIG. 3C, a temperature of the heater 110 may be maintained constant for a predetermined time period after the aerosol generating article 200 is discharged from the aerosol generating device 100. That is, when the aerosol generating article 200 is used for the first time and then discharged, the aerosol generating device 100 may maintain the temperature of the heater 110 constant for a predetermined time.

For example, the temperature of the heater 110 may be maintained for a certain time period T when the aerosol generating article 200 is discharged. When the aerosol generating article 200*a* that is not preheated is inserted into the accommodation portion 105 during the time period T, a temperature of the heater 110 may be reduced by d3.

On the other hand, when the preheated aerosol generating article 200*b* is inserted into the accommodation portion 105 during the time period T, the temperature of the heater 110 may be reduced by d4. As the temperature of the heater 110 is maintained constant for a predetermined time period, a change in a temperature of the heater 110 may show up more clearly. That is, as the temperature of the heater 110 is maintained constant for a predetermined time, a change in temperature data of the heater 110, for example, a temperature difference may increase.

The temperature difference d3 may be greater than temperature difference d4. If the temperature difference is less than a predetermined reference value, it may be determined that the aerosol generating article is reused. Thereafter, the controller 130 may generate a reuse detection signal.

When the temperature difference of the heater 110 is greater than or equal to the predetermined reference value, it may be determined that the aerosol generating article is used for the first time. Thereafter, the controller 130 may generate a reuse non-detection signal. The reference values for the temperature difference may differ according to embodiments. For example, it may be appropriately selected from a range of 1° C. to 3° C.

Measuring a temperature of the heater 110 and analyzing a change in the temperature data of the heater 110, which are described above with respect to FIGS. 2A to 2C and FIGS. 3A to 3C, may be performed after a predetermined condition is satisfied.

The predetermined condition may be, for example, that the number of puffs exceeds a predetermined number.

As another example, the predetermined condition may be that a use time of the aerosol generating device 100 after insertion of the aerosol generating article 200 exceeds a predetermined time.

If the above-described condition is satisfied, a temperature of the heater 110 may be measured and the temperature data of the heater 110 may be analyzed as described above, and a reuse detection signal or a reuse non-detection signal may be generated based on a change in the temperature data.

Figure 4:
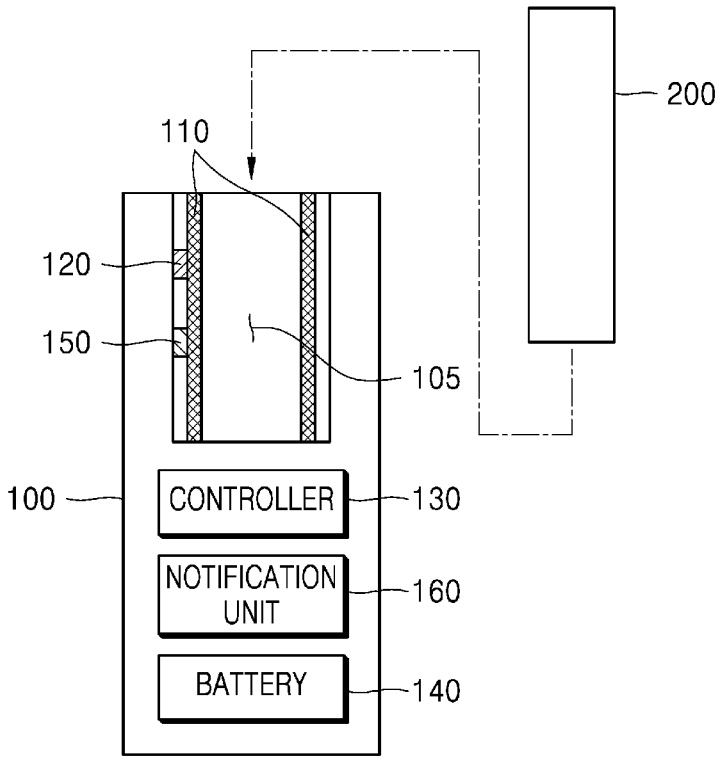
FIG. 4 is a cross-sectional view of an aerosol generating device according to another embodiment.

FIG. 4 is a cross-sectional view of an aerosol generating device 100 according to another embodiment.

The temperature sensor 120 may measure a temperature of the heater 110.

The controller 130 may acquire temperature data of the heater 110 based on the temperature of the heater 110 measured by the temperature sensor 120. The controller 130 may generate a reuse detection signal or a reuse non-detection signal based on a change in temperature data of the heater 110. The temperature data of the heater 110 acquired by the controller 130 may be temperature values of the heater 10 recorded over time.

As an example, when the controller 130 generates a reuse detection signal based on a change in temperature data of the heater 110, the controller 130 may stop operation of the aerosol generating device 100 by controlling power supplied by the battery 140.

As another example, when the controller 130 generates a reuse detection signal based on a change in temperature data of the heater 110, the controller 130 may generate a notification signal for notifying a user of reuse of the aerosol generating article 200.

The aerosol generating device 100 may further include a notification unit 160. The notification unit 160 may be at least one of a vibrator, a speaker, and a display, and the notification unit 160 may be mounted on the aerosol generating device 100 to notify a user of a state of the aerosol generating device 100. The notification unit 160 may output at least one of vibration, sound, and light to a user, according to a notification signal from the controller 130.

For example, a display may be mounted in the aerosol generating device 100 as the notification unit 160. In this case, when a reuse detection signal is generated based on a change in temperature data of the heater 110, the controller 130 may generate a notification signal for notifying reuse of the aerosol generating article 200.

The notification signal generated by the controller 130 may be transmitted to the display, and the display may transmit a light signal for notifying a user of reuse of the aerosol generating article 200. In this case, the light signal may be a predetermined image or text through which a user may recognize reuse of the aerosol generating article 200.

The aerosol generating device 100 according to the embodiments may detect reuse of the aerosol generating article 200 by measuring a temperature of the heater 110 according to insertion of the aerosol generating article 200.

When reuse of the aerosol generating article 200 is detected, operation of the aerosol generating device 100 may be blocked. Alternatively, the notification unit 160 provided in the aerosol generating device 100 may notify a user of reuse of the aerosol generating article 200.

As reuse of an aerosol generating article 200 is blocked, it is possible to prevent satisfaction of a user from being reduced due to a change in flavor of an aerosol that may occur due to reuse.

At least one of the components, elements, modules or units (collectively "components" in this paragraph) represented by a block in the drawings, such as the controller 130, may be embodied as various numbers of hardware, software and/or firmware structures that execute respective functions described above, according to an exemplary embodiment. For example, at least one of these components may use a direct circuit structure, such as a memory, a processor, a logic circuit, a look-up table, etc. that may execute the respective functions through controls of one or more microprocessors or other control apparatuses. Also, at least one of these components may be specifically embodied by a module, a program, or a part of code, which contains one or more executable instructions for performing specified logic functions, and executed by one or more microprocessors or other control apparatuses. Further, at least one of these components may include or may be implemented by a processor such as a central processing unit (CPU) that performs the respective functions, a microprocessor, or the like. Two or more of these components may be combined into one single component which performs all operations or functions of the combined two or more components. Also, at least part of functions of at least one of these components may be performed by another of these components. Further, although a bus is not illustrated in the above block diagrams, communication between the components may be performed through the bus. Functional aspects of the above exemplary embodiments may be implemented in algorithms that execute on one or more processors. Furthermore, the components represented by a block or processing steps may employ any number of related art techniques for electronics configuration, signal processing and/or control, data processing and the like.

Those skilled in the technical field relating to the present embodiments will appreciate that the embodiments may be implemented in a modified form without departing from the essential characteristics of the above description. Therefore, the disclosed methods should be considered in a descriptive sense only and not for purposes of limitation. The scope of the present disclosure is illustrated in the claims rather than the foregoing description, and all differences within the scope equivalent thereto should be construed as being included in the present disclosure.

[EXPLANATION OF REFERENCE NUMERALS DESIGNATING THE MAJOR ELEMENTS OF THE DRAWINGS]

100: aerosol generating device
105: accommodation portion
110: heater
120: temperature sensor
130: controller
140: battery
150: aerosol generating article detection sensor 160: notification unit
200, 200a, 200b: aerosol generating article

What is claimed is:

1. An aerosol generating device comprising:

an accommodation portion configured to accommodate an aerosol generating article;

a heater configured to heat the aerosol generating article inserted in the accommodation portion;

a temperature sensor configured to measure a temperature of the heater; and a controller configured to:

acquire temperature data of the heater based on the temperature of the heater measured by the temperature sensor; and generate a reuse detection signal based on a change in the temperature data which is caused by insertion of the aerosol generating article into the accommodation portion, wherein the reuse detection signal indicates the aerosol generating article was preheated before being inserted in the accommodation portion.

2. The aerosol generating device of claim 1, wherein the controller is configured to generate the reuse detection signal based on the change in the temperature data being less than a predetermined value.

3. The aerosol generating device of claim 1, wherein the change in the temperature data indicates a rate of change in a temperature gradient of the heater.

4. The aerosol generating device of claim 3, wherein the controller is configured to generate the reuse detection signal based on the rate of change in the temperature gradient of the heater being less than 150%.

5. The aerosol generating device of claim 1, wherein the change in the temperature data indicates a difference between a temperature of the heater measured at a specific point in time before the aerosol generating article is inserted and a temperature of the heater measured at a specific point in time after the aerosol generating article is inserted.

6. The aerosol generating device of claim 5, wherein the controller generates the reuse detection signal based on the difference being less than a predetermined reference value in a range of 1° C. to 3° C.

7. The aerosol generating device of claim 1, wherein the change in the temperature data indicates a difference between an average temperature of the heater during a predetermined period before the aerosol generating article is inserted and an average temperature of the heater during a predetermined period after the aerosol generating article is inserted.

8. The aerosol generating device of claim 1, wherein the temperature of the heater is maintained constant for a predetermined time period after the aerosol generating article is discharged.

9. The aerosol generating device of claim 8, wherein the temperature of the heater is maintained at a constant temperature in a range of 120° C. to 160° C. after the aerosol generating article is discharged.

10. The aerosol generating device of claim 8, wherein the heater is maintained constant for 20 to 40 seconds after the aerosol generating article is discharged.

11. The aerosol generating device of claim 1, further comprising:

an aerosol generating article detection sensor configured to detect insertion and discharge of the aerosol generating article.

12. The aerosol generating device of claim 11, wherein the aerosol generating article detection sensor includes at least one of a pressure sensor, an optical sensor, an infrared sensor, an inductive sensor, a capacitance sensor, a resistance sensor, and a geomagnetic sensor.

13. The aerosol generating device of claim 1, wherein the controller is configured to stop operation of the aerosol generating device when the reuse detection signal is generated.

14. The aerosol generating device of claim 1, wherein the controller generates a notification signal for notifying a user of reuse of the aerosol generating article when the reuse detection signal is generated.

15. The aerosol generating device of claim 14, further comprising at least one of a vibrator, a speaker, and a display, which is configured to output a notification corresponding to the notification signal.

* * * * *